US007823945B2

(12) United States Patent
Gilliss et al.

(10) Patent No.: US 7,823,945 B2
(45) Date of Patent: Nov. 2, 2010

(54) PIPE ENGAGING AND LIFTING APPARATUS

(75) Inventors: Dean Gilliss, Lampman (CA); Randy Phillips, Lampman (CA)

(73) Assignee: Dean Gillis and Bonita Gillis, Saskatchewan (CA)

( * ) Notice: Subject to any disclaimer, the term of this patent is extended or adjusted under 35 U.S.C. 154(b) by 951 days.

(21) Appl. No.: 11/565,725

(22) Filed: Dec. 1, 2006

(65) Prior Publication Data

US 2007/0164578 A1 Jul. 19, 2007

(30) Foreign Application Priority Data

Jan. 19, 2006 (CA) ..... 2533187

(51) Int. Cl.
*B66C 1/62* (2006.01)

(52) U.S. Cl. ..... 294/104

(58) Field of Classification Search ..... 294/104, 294/16, 165, 169, 50.9
See application file for complete search history.

(56) References Cited

U.S. PATENT DOCUMENTS 2,342,506 A * 2/1944 Wrobbel ..... 294/106
3,068,036 A * 12/1962 Doty ..... 294/104
3,101,968 A * 8/1963 Cianchette et al. ..... 294/104
3,165,347 A * 1/1965 Keskitalo ..... 294/104
3,479,078 A * 11/1969 Doty ..... 294/104
4,026,593 A * 5/1977 Brown et al. ..... 294/110.1
4,097,084 A 6/1978 Russell
4,743,056 A 5/1988 Oliason

* cited by examiner

*Primary Examiner*—Paul T Chin
(74) *Attorney, Agent, or Firm*—Frost Brown Todd LLC

(57) ABSTRACT

A pipe clamping apparatus comprises a housing defining a pipe aperture with an open bottom. A jaw is pivotally attached inside the housing. When the jaw is in the open position, an upper portion of the jaw extends into the pipe aperture. In operation the top of the pipe contacts the upper portion of the jaw moving the upper portion of the jaw upward and moving a lower portion of the jaw laterally toward the housing to the closed position where the housing and the jaw are in close proximity to the pipe, and the bottom end of the left side portion is located under the pipe. When the jaw is in the closed position, a blocking member can be moved to a locked position to prevent the jaw from moving back toward the open position, and a lock indicator visibly indicates that the jaw is locked closed.

19 Claims, 1 Drawing Sheet

PIPE ENGAGING AND LIFTING APPARATUS

FIELD OF THE INVENTION

This invention is in the field of equipment for engaging pipes and like objects, and in particular for engaging such objects for the purpose of lifting same.

BACKGROUND OF THE INVENTION

Generally cylindrical objects are used in various enterprises for many purposes, and are often quite large and so require equipment to be adapted for moving same. Pipes and tubing for example are commonly used in oil field application and must be lifted and maneuvered onto vehicles for transport and also during use at a work location. Commonly such pipes are maneuvered with a crane or the like by lowering a cable with a clamping apparatus, typically a set of pipe tongs, on the end thereof to engage the pipe tongs onto the pipe. Care must be taken that the pipe is positively engaged in the tongs in order to ensure the pipe does not slip out of the tongs and cause injury to workers below the pipe, and damage to equipment.

Such tongs are generally illustrated in U.S. Pat. Nos. 3,068,036 to Doty, 4,097,084 to Russell and 4,743,056 to Oliason. These tongs are configured such that the tongs are engaged on the pipe by lifting up on the cable attached to the tongs. U.S. Pat. No. 2,873,995 to Turner discloses a clamp apparatus that has a pivoting tong that contacts the top of the pipe and moves to a closed position engaging the pipe as the clamp apparatus moves further down, and then the pivoting tong is latched such that a force upward on the handle raises the pipe. The clamp apparatus of Turner is grasped manually by a handle and placed on the pipe, and when the free tong is latched, forces on the handle or the apparatus generally do not affect the gripping action of the apparatus on the pipe.

SUMMARY OF THE INVENTION

It is an object of the present invention to provide a clamping apparatus for engaging and lifting a pipe that overcomes problems in the prior art.

In a first embodiment the invention provides an apparatus for clamping a pipe. The apparatus comprises a housing including left and right side portions extending outward and downward from a top of the housing and defining a pipe aperture with an open bottom. The left side portion extends substantially in an arc from a top of the pipe aperture outward and downward and then inward to a bottom end of the left side portion of the housing, and the right side portion of the housing extends outward and downward from the top of the pipe aperture in a direction opposite the left side portion. A curved jaw is pivotally attached inside the right side portion of the housing about a jaw axis substantially aligned with a longitudinal pipe axis of a pipe clamped in the pipe location, and located above and to the right of the pipe axis, and the jaw can pivot from an open position to a closed position. When the jaw is in the open position, an upper portion of the jaw extends into an upper portion of the pipe aperture and a pipe opening is defined between the bottom end of the jaw and the bottom end of the left side portion of the housing that will allow the pipe to enter the pipe aperture. In operation the housing is moved downward onto a pipe such that a top of the pipe contacts the upper portion of the jaw moving the upper portion of the jaw upward and moving a lower portion of the jaw laterally toward the left side portion of the housing to the closed position where the left side portion of the housing and the jaw are in close proximity to the pipe, and wherein the bottom end of the left side portion is located under the pipe. A locking mechanism is mounted in the housing and comprises a blocking member movable from an unlocked position to a locked position. When the jaw is in the closed position, the blocking member can be moved to the locked position to prevent the jaw from moving back toward the open position, and a lock indicator is operative to visibly indicate that the blocking member is in the locked position.

In a second embodiment the invention provides an apparatus for clamping a pipe. The apparatus comprises a housing including left and right side portions extending outward and downward from a top of the housing and defining a pipe aperture with an open bottom. The left side portion extends substantially in an arc from a top of the pipe aperture outward and downward and then inward to a bottom end of the left side portion of the housing, and the right side portion of the housing extends outward and downward from the top of the pipe aperture in a direction opposite the left side portion. A curved jaw is pivotally attached inside the right side portion of the housing about a jaw axis substantially aligned with a longitudinal pipe axis of a pipe clamped in the apparatus, and located above and to the right of the pipe axis, and wherein the jaw can pivot from an open position to a closed position. An upper end of the jaw extends externally above the housing on the left side of the jaw axis and is adapted for attachment of a lifting device. When the jaw is in the open position, an upper portion of the jaw extends into an upper portion of the pipe aperture and a pipe opening is defined between the bottom end of the jaw and the bottom end of the left side portion of the housing that will allow the pipe to enter the pipe aperture. In operation the housing is moved downward onto a pipe such that a top of the pipe contacts the upper portion of the jaw moving the upper portion of the jaw upward and moving a lower portion of the jaw laterally toward the left side portion of the housing to the closed position where the left side portion of the housing and the jaw are in close proximity to the pipe, and the bottom end of the left side portion is located under the left side of the pipe, and a bottom end of the jaw is under a right side of the pipe. An upward force exerted on the upper end of the jaw by the lifting device to lift a clamped pipe is also exerted laterally on the lower portion of the jaw causing the jaw to exert a force on the clamped pipe toward the left side portion of the housing. A locking mechanism is mounted in the housing and comprises a blocking member movable from an unlocked position to a locked position. When the jaw is in the closed position, the blocking member can be located between the jaw and the housing in the locked position to prevent the jaw from moving back toward the open position. A lock indicator is operative to visibly indicate that the blocking member is in the locked position.

The jaw and housing are typically configured such that the apparatus can be gripped by hand and lowered onto a pipe such that the pipe moves up through the pipe opening into the pipe aperture as the apparatus moves down. When the jaw is in the closed position, the pipe is substantially bearing against the arc defined by the left side portion of the housing, and the end of the arc on the bottom end of the left side portion is under the left side of the pipe, and a bottom end of the curved jaw is under the right side of the pipe. The jaw is locked so it cannot move back toward the open position. Also where the lifting device is attached to the upper end of the jaw, the upward force exerted on the jaw by the cable hook further forces and clamps the pipe against the arc defined by the left side of the housing.

Persons operating the apparatus can see that the locking mechanism is closed and the apparatus is properly engaged.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
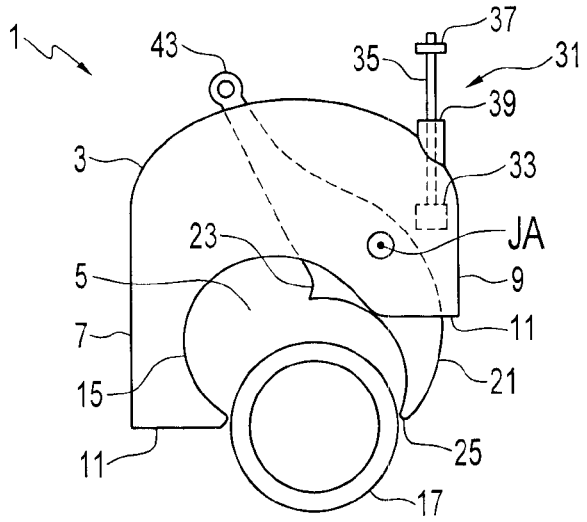
FIG. 1 is schematic front view of an embodiment of a clamping apparatus of the present invention in the open position with a pipe entering the pipe aperture through the pipe opening.
Figure 2:
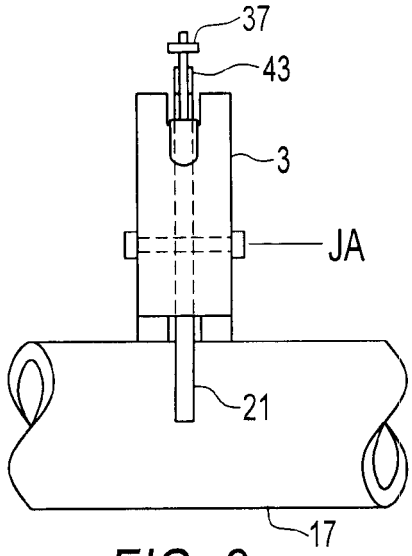
FIG. 2 is a schematic side view of the embodiment of FIG. 1.
Figure 3:
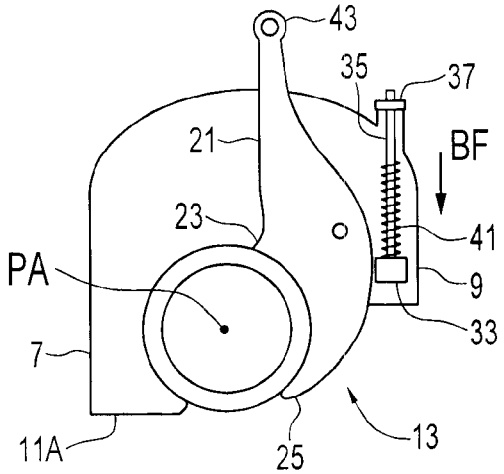
FIG. 3 is schematic front view of the embodiment of FIG. 1 in the closed position with the front plate of the housing removed to better illustrate the jaw and locking mechanism.

FIGS. 1-3 illustrate an apparatus 1 of the invention for clamping a pipe in a pipe location within the apparatus 1. The apparatus 1 comprises a housing 3 defining a pipe aperture 5 with an open bottom. The housing 3 includes left and right side portions 7, 9 extending outward and downward from the top of the housing on each side of the pipe aperture 5 such that a bottom portion of the pipe aperture 5 is open.

The left side portion 7 extends substantially in an arc from a top of the pipe aperture 5 outward and downward and then inward to a bottom end 11 of the left side portion 7 of the housing 3. The left side portion 7 is configured to define a left portion 15 of the pipe aperture that is substantially an arc of a circle with a diameter corresponding substantially the diameter of the pipe 17 or like cylindrical object that is to be lifted. The arc extends from the top of the pipe aperture outward and downward and then inward at the bottom of the left side portion 7. The right side portion 9 of the housing 3 extends outward and downward from the top of the pipe aperture 5 in a direction opposite the left side portion 7.

A curved pipe engaging jaw 21 is pivotally attached inside the right side portion 9 of the housing 3 about a jaw axis JA substantially aligned with a pipe axis PA of a pipe 17 clamped in the closed apparatus as illustrated in FIG. 3 and located above and toward the right of the pipe axis PA. The jaw 21 can pivot from an open position illustrated in FIG. 1 to a closed position illustrated in FIG. 3.

In the open position, illustrated in FIG. 1 the jaw 21 is oriented such that an upper portion 23 of the jaw 21 extends into the pipe aperture 5, and a pipe opening 13 is defined between the bottom end 25 of the jaw and the bottom end 11 of the left side portion 7 of the housing 3 that will allow a pipe 17 to enter the pipe aperture 5.

The jaw 21 and housing 3 are configured such that the apparatus 1 can be lowered onto a pipe 17, conveniently manually by an operator, such that the pipe 17 moves up through the pipe opening 13 into the pipe aperture 5 as the apparatus 1 moves down, as illustrated in FIG. 1. As the pipe 17 moves upward in the pipe aperture 5, the top of the pipe 17 contacts the upper portion 23 of the jaw 21 moving the upper portion 23 of the jaw 21 upward and moving the lower portion of the jaw 21 laterally toward the left side portion 7 of the housing 3 to the closed position of FIG. 3 where the left side portion 7 of the housing 3 and the jaw 21 are in close proximity to the pipe 17, and wherein the bottom end 11A of the left side portion 7 is located tinder the left side of the pipe 17, and a bottom end 25 of the jaw 21 is tinder a right side of the pipe 17. This movement is relative, and where the pipe 17 is large, the apparatus 1 will move in the opposite direction such that the left side portion 7 of the housing 3 moves toward the pipe 17, and the pipe 17 will stay substantially stationary.

As can be seen in FIG. 3, left and right side portions 7, 9 of the housing 3 and the jaw 21 are configured such that when the jaw 21 is in the illustrated closed position, the housing 3 and jaw 21 define a substantially cylindrical pipe location with a diameter corresponding substantially to the diameter of the pipe 17.

To ensure engagement of the pipe 17 in the pipe aperture 5 is maintained, the apparatus 1 includes a locking mechanism 31 mounted in the housing 3 and comprising a blocking member 33 movable from an unlocked position illustrated in FIG. 1 to a locked position illustrated in FIG. 3. When the jaw 21 is in the closed position of FIG. 3, the blocking member 33 can be located as illustrated between the jaw 21 and a wall of the housing 3 in the locked position to prevent the jaw 21 from moving back toward the open position. In the illustrated embodiment the locking mechanism 31 comprises a blocking member 33 attached to the lower end of a lock rod 35, and a collar 37 attached to the upper end of the rod 35. A bias element, provided in the illustrated embodiment by a spring 41, as illustrated in FIG. 3 but not in FIGS. 1 and 2 for clarity of illustration, is located inside the right portion 9 of the housing 3, and exerts a bias force BF between the blocking member 33 and the housing 3. The rod 35 extends through a port 39 in the housing 3, and the spring 41 exerts a bias force BF on the blocking member 33 and rod 35 in the downward direction as illustrated and moves the blocking member 33 into the locked position when the jaw 21 is in the closed position.

Exerting an upward force on the exterior end of the lock rod 35, conveniently by grasping the collar 37, against the bias force BF moves the blocking member 33 to the unlocked position of FIG. 1 to allow the jaw to move to the open position and release the pipe 17.

Thus when the apparatus 1 is lowered onto the pipe 17, the jaw 21 will pivot toward the closed position of FIG. 3, and the blocking member 33 will follow the jaw 21 downward in response to the bias force BF. When the jaw is in the closed position of FIG. 3, the blocking member 33 is positioned between the jaw 21 and the housing 3 and prevents the jaw 21 from moving toward the open position. The position of the collar 37 is adjustable on the rod 35 to adjust the position of the blocking member 33 relative to the housing 3.

A lock indicator is operative to visibly indicate that the blocking member 33 is in the locked position. In the illustrated embodiment the lock indicator is provided by the lock rod 35. As the jaw 21 moves to the closed position, the rod 35 and collar 37 move downward to a closed position as well, such that persons operating the apparatus 1 can see that the locking mechanism 31 is locked and the apparatus 1 is properly engaged.

The upper end 43 of the jaw 21 extends externally above the housing 3 on the left side of the jaw axis JA and is adapted for attachment of a cable hook or like lifting device to lift the pipe 17. Thus as upward force is exerted on the upper end 43 of the jaw 21 by the cable hook to lift a clamped pipe, the force is also exerted laterally on the lower portion of the jaw 21 bearing against the pipe 17 and forcing the pipe 17 against the arc defined by the left side portion 7 of the housing 3.

Once the pipe 17 is in the desired location and resting on the ground or like surface, tension is released on the upper end 43 of the jaw 21, and the collar 37 is grasped and pulled upward, moving the blocking member 33 and releasing the jaw 21 to allow same to move to the open position to release the pipe 17.

The housing 3 provides a strong and rigid foundation for mounting the movable jaw and lock mechanism parts. The apparatus 1 can be scaled up or down as required to engage pipes with a range of diameters.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An apparatus for clamping a pipe, the apparatus comprising:

a housing including left and right side portions extending outward and downward from a top of the housing and defining a pipe aperture with an open bottom;

wherein the left side portion extends substantially in an arc from a top of the pipe aperture outward and downward and then inward to a bottom end of the left side portion of the housing, and the right side portion of the housing extends outward and downward from the top of the pipe aperture in a direction opposite the left side portion;

a curved jaw pivotally attached inside the right side portion of the housing about a jaw axis substantially aligned with a longitudinal pipe axis of a pipe clamped in the apparatus, and located above and to the right of the pipe axis, and wherein the jaw can pivot from an open position to a closed position;

wherein when the jaw is in the open position, an upper portion of the jaw extends into an upper portion of the pipe aperture to the left of the jaw axis and a pipe opening is defined between the bottom end of the jaw and the bottom end of the left side portion of the housing that will allow the pipe to enter the pipe aperture;

where in operation the housing is moved downward onto a pipe such that a top of the pipe contacts the upper portion of the jaw and pivots the jaw about the jaw axis such that the upper portion of the jaw moves upward out of the pipe opening and a lower portion of the jaw moves laterally toward the left side portion of the housing to the closed position where the left side portion of the housing and the jaw are in close proximity to the pipe, and wherein the bottom end of the left side portion is located under the pipe; and a locking mechanism mounted in the housing and comprising a blocking member movable from an unlocked position to a locked position;

wherein when the jaw is in the closed position, the blocking member can be moved to the locked position to prevent the jaw from moving back toward the open position; and a lock indicator operative to visibly indicate that the blocking member is in the locked position.

2. The apparatus of claim 1 wherein the left side portion of the housing extends in an arc that is substantially an arc of a circle with a diameter corresponding substantially to the diameter of the pipe.

3. The apparatus of claim 2 wherein the left and right side portions of the housing and the jaw are configured such that when the jaw is in the closed position, the housing and jaw define a substantially cylindrical pipe location with a diameter corresponding substantially to the diameter of the pipe.

4. The apparatus of claim 1 wherein an upper end of the jaw extends externally above the housing on the left side of the jaw axis and is adapted for attachment of a lifting device, and wherein an upward force exerted on the upper end of the jaw by the lifting device to lift a clamped pipe is also exerted laterally on the lower portion of the jaw causing the jaw to exert a force on the clamped pipe toward the left side portion of the housing.

5. The apparatus of claim 1 wherein when the jaw is in the closed position, the blocking member can be located between the jaw and the housing in the locked position to prevent the jaw from moving back toward the open position.

6. The apparatus of claim 5 wherein the locking mechanism comprises a bias element operative to move the blocking member into the locked position when the jaw is in the closed position.

7. The apparatus of claim 6 wherein the bias element is located inside the right portion of the housing, and exerts a bias force between the blocking member and the housing.

8. The apparatus of claim 7 wherein the locking mechanism comprises a lock rod attached to the blocking member and extending out of the housing and wherein exerting a force on an exterior end of the lock rod against the bias force moves the blocking member to the unlocked position.

9. The apparatus of claim 8 wherein the lock indicator is provided by the lock rod.

10. The apparatus of claim 9 comprising a collar attached to the exterior end of the lock rod and operative to adjust a position of the blocking member relative to the housing.

11. The apparatus of claim 1 where the jaw and housing are configured such that when the jaw moves from the closed position toward the open position, the lower portion of the jaw moves closer to a wall of the housing, and wherein the blocking member is located between the lower portion of the jaw and the wall of the housing when in the locked position.

12. An apparatus for clamping a pipe, the apparatus comprising:

a housing including left and right side portions extending outward and downward from a top of the housing and defining a pipe aperture with an open bottom;

wherein the left side portion extends substantially in an arc from a top of the pipe aperture outward and downward and then inward to a bottom end of the left side portion of the housing, and the right side portion of the housing extends outward and downward from the top of the pipe aperture in a direction opposite the left side portion;

a curved jaw pivotally attached inside the right side portion of the housing about a jaw axis substantially aligned with a longitudinal pipe axis of a pipe clamped in the apparatus, and located above and to the right of the pipe axis, and wherein the jaw can pivot from an open position to a closed position;

wherein an upper end of the jaw extends externally above the housing on the left side of the jaw axis and is adapted for attachment of a lifting device;

wherein when the jaw is in the open position, an upper portion of the jaw extends into an upper portion of the pipe aperture to the left of the jaw axis and a pipe opening is defined between the bottom end of the jaw and the bottom end of the left side portion of the housing that will allow the pipe to enter the pipe aperture;

where in operation the housing is moved downward onto a pipe such that a top of the pipe contacts the upper portion of the jaw and pivots the jaw about the jaw axis such that the upper portion of the jaw moves upward out of the pipe opening and a lower portion of the jaw moves laterally toward the left side portion of the housing to the closed position where the left side portion of the housing and the jaw are in close proximity to the pipe, and wherein the bottom end of the left side portion is located under the left side of the pipe, and a bottom end of the jaw is under a right side of the pipe;

wherein an upward force exerted on the upper end of the jaw by the lifting device to lift a clamped pipe pivots the jaw about the jaw axis such that the lower portion of the jaw exerts a force on the clamped pipe toward the left side portion of the housing; and a locking mechanism mounted in the housing and comprising a blocking member movable from an unlocked position to a locked position;

wherein when the jaw is in the closed position, the blocking member can be located between the jaw and the housing in the locked position to prevent the jaw from moving back toward the open position; and a lock indicator operative to visibly indicate that the blocking member is in the locked position.

13. The apparatus of claim 12 wherein the left side portion of the housing extends in an arc that is substantially an arc of a circle with a diameter corresponding substantially to the diameter of the pipe.

14. The apparatus of claim 13 wherein the left and right side portions of the housing and the jaw are configured such that when the jaw is in the closed position, the housing and jaw define a substantially cylindrical pipe location with a diameter corresponding substantially to the diameter of the pipe.

15. The apparatus of claim 12 wherein the locking mechanism comprises a bias element operative to move the blocking member into the locked position when the jaw is in the closed position.

16. The apparatus of claim 15 wherein the bias element is located inside the right portion of the housing, and exerts a bias force between the blocking member and the housing.

17. The apparatus of claim 16 wherein the locking mechanism comprises a lock rod attached to the blocking member and extending out of the housing and wherein exerting a force on an exterior end of the lock rod against the bias force moves the blocking member to the unlocked position.

18. The apparatus of claim 17 wherein the lock indicator is provided by the lock rod.

19. The apparatus of claim 18 comprising a collar attached to the exterior end of the lock rod and operative to adjust a position of the blocking member relative to the housing.

* * * * *